US009457247B2

(12) United States Patent
Fitzgerald et al.

(10) Patent No.: US 9,457,247 B2
(45) Date of Patent: Oct. 4, 2016

(54) BAT WITH BIFURCATED INTERNAL CAVITIES

(71) Applicant: BPS DIAMOND SPORTS CORP., Ottawa (CA)

(72) Inventors: Stephen Bruce Fitzgerald, Halifax (CA); Frederic St-Laurent, Chelsea (CA); Ralph Edward Mitton, Ottawa (CA)

(73) Assignee: BPS DIAMOND SPORTS CORP., Ottawa (CA)

( * ) Notice: Subject to any disclaimer, the term of this patent is extended or adjusted under 35 U.S.C. 154(b) by 0 days.

(21) Appl. No.: 14/657,706

(22) Filed: Mar. 13, 2015

(65) Prior Publication Data

US 2015/0190692 A1 Jul. 9, 2015

Related U.S. Application Data

(62) Division of application No. 13/708,654, filed on Dec. 7, 2012, now abandoned.

(51) Int. Cl.
*A63B 59/06* (2006.01)

(52) U.S. Cl.
CPC ..... *A63B 59/06* (2013.01); *A63B 59/50* (2015.10); *A63B 60/42* (2015.10); *A63B 59/54* (2015.10); *A63B 2060/002* (2015.10); *A63B 2102/18* (2015.10)

(58) Field of Classification Search
CPC ..... A63B 2102/18; A63B 2102/182; A63B 59/50–59/58; A63B 59/581; A63B 60/54
USPC ..... 473/457, 519, 520, 564–568
See application file for complete search history.

(56) References Cited

U.S. PATENT DOCUMENTS

| | | | | |
|---|---|---|---|---|
| 3,861,682 | A * | 1/1975 | Fujii | A63B 59/50 473/520 |
| 3,963,239 | A | 6/1976 | Fujii | |
| 5,094,453 | A | 3/1992 | Douglas et al. | |
| 5,303,917 | A | 4/1994 | Uke | |
| 5,364,095 | A | 11/1994 | Easton et al. | |
| 5,415,398 | A | 5/1995 | Eggiman | |
| 6,251,034 | B1 | 6/2001 | Eggiman et al. | |
| 6,287,222 | B1 | 9/2001 | Pitsenberger | |
| 6,425,836 | B1 | 7/2002 | Misono et al. | |
| 6,440,017 | B1 | 8/2002 | Anderson | |
| 6,461,260 | B1 | 10/2002 | Higginbotham | |
| 6,729,983 | B1 | 5/2004 | Vakili et al. | |
| 6,949,038 | B2 | 9/2005 | Fritzke | |
| 8,062,154 | B2 | 11/2011 | Burger | |
| 8,298,102 | B2 | 10/2012 | Chauvin et al. | |
| 8,449,412 | B2 * | 5/2013 | Vander Pol | A63B 59/50 473/566 |
| 8,480,519 | B2 | 7/2013 | Chauvin et al. | |
| 8,632,428 | B2 | 1/2014 | Burger | |
| 8,727,917 | B2 | 5/2014 | Vander Pol et al. | |
| 8,795,108 | B2 | 8/2014 | Chauvin et al. | |
| 2002/0094892 | A1 | 7/2002 | Chauvin et al. | |
| 2004/0053716 | A1 * | 3/2004 | Wu | A63B 59/50 473/564 |
| 2005/0070384 | A1 | 3/2005 | Fitzgerald et al. | |
| 2010/0160095 | A1 | 6/2010 | Chauvin et al. | |
| 2011/0152015 | A1 | 6/2011 | Burger | |
| 2014/0342856 | A1 | 11/2014 | Chauvin et al. | |

* cited by examiner

*Primary Examiner* — Mark Graham
(74) *Attorney, Agent, or Firm* — Perkins Coie LLP

(57) ABSTRACT

A tubular bat is provided whereby at least one diaphragm is located within the internal cavity of the bat. The diaphragm is fastened at its peripheral edge to the inner surface of the bat wall, thereby dividing the internal cavity into two separated cavities, thus creating two sweet spots, or shifting the existing sweet spot forward towards the distal end of the bat. This improves player performance by providing an expanded number of optimal hitting zones or by moving the optimal hitting zone farther from the bat handle.

22 Claims, 12 Drawing Sheets

BAT WITH BIFURCATED INTERNAL CAVITIES

CROSS-REFERENCE TO RELATED APPLICATION

This application is a divisional application of U.S. application Ser. No. 13/708,654 filed on Dec. 7, 2012, the contents of which are incorporated herein by reference in their entirety.

FIELD OF THE INVENTION

The present invention relates to baseball bats and more particularly to tubular single wall or multi-wall baseball bats, constructed of any of a variety of materials, and designed to improve player performance while meeting regulatory requirements limiting bat performance. Baseball bats according to the present invention have one or more thin, lightweight diaphragms selectively placed within the tubular bat cavity to thereby modify the fundamental hoop mode of the bat, resulting in a bifurcation of the fundamental barrel hoop mode, or a selective relocation of the peak of the fundamental hoop mode (commonly referred to as being generally concurrent with the bat's sweet spot) along the bat barrel length, while at the same time limiting bat performance. The result is the creation of at least two sweet spots, or movement of the sweet spot along the bat barrel length.

BACKGROUND

Baseball and softball bats, hereinafter referred to simply as "baseball bats" or "bats", are today typically made solely from aluminum alloys, or aluminum alloys in combination with composite materials (hybrid bats), or most recently solely from composite materials (with the exception of solid wooden bats for the Major Leagues). Such bats are tubular (hollow inside) in construction in order to meet the weight requirement of the end user, have a cylindrical handle portion for gripping, a cylindrical barrel portion for hitting, and a tapered mid-section connecting the handle and barrel portions.

When aluminum alloys initially replaced wooden bats in most bat categories, the bats were formed as a single aluminum member, that is, they were made in a unitary manner as a single-wall aluminum tube for the handle, taper, and barrel portions. Such bats are often called single-wall aluminum bats and were known to improve performance relative to wooden bats as defined by increased hitting distance. More recently (in the mid 1990's), improvements in bat design largely concentrated on further improving bat performance. This was accomplished by thinning the barrel wall of the single-wall bat frame, and adding inner or internal, and/or outer or external secondary members extending along the entire barrel length. These members are often referred to respectively as inserts or sleeves; while the main member is often referred to as a body, shell or frame. Such bats, constructed of metallic and/or composite materials are often called double-walled bats or multi-walled bats in the case of more than two walls resulting from two or more secondary members.

Such double-walled and multi-walled tubular bats generally attained improved performance in terms of hitting distance by reason of the improved deflection that is characteristic of a multilayer barrel wall. The efficient batting of a ball is maximized by minimizing plastic deformation, both within the bat and within the ball. Ideally, during the bat-ball collision, the barrel wall of the bat should not deform beyond its elastic limit. In a multi-walled bat, having two or more members along the entire barrel length, the barrel portion is allowed to elastically deflect or flex more upon ball impact, which propels the ball faster and further than prior art single wall bats.

The scientific principle governing improved tubular bat performance is bending theory. When a ball impacts a tubular bat it has kinetic energy that must be absorbed by the bat in order to stop the ball. The bat stores most of this energy by flexing, which results in various vibrational bending modes. The ball as well deforms in a hoop direction. The first or fundamental hoop bending mode of a tubular bat gives rise to what is commonly referred to as a tubular bat's trampoline effect, which can increase bat performance. The peak of this first bending mode is often referred to as being approximately concurrent with the bat's sweet spot. After the ball is stopped, the bat returns the energy it has stored by rebounding and sending the ball towards from where it came. The more the bat barrel or striking portion deforms upon ball impact without failing (denting or breaking) or experiencing plastic deformation, the lower the energy loss and the greater the energy returned to the ball from the bat as the tubular bat barrel portion returns to its original shape following impact.

To allow the bat barrel portion to deform requires lowering the radial stiffness of the barrel portion. The prior art double-walled and multi-walled tubular bats have traditionally accomplished this by thinning the main member of the barrel portion and adding thin secondary member insert(s) and/or sleeve(s) which are not bonded to the main member, but which generally extend throughout the full length of the barrel portion. Such inserts and sleeves are not coupled to the barrel wall portion of the frame, and these two contacting components may slide with respect to each other in the same manner as leafs within a leaf spring. The resultant lowered radial stiffness along the barrel portion length permits the barrel wall to deflect elastically.

U.S. Pat. No. 5,415,398 is an example of a multi-walled bat that discloses use of a frame and an internal insert of constant thickness running full length of the barrel portion of the bat in a double-wall construction.

Other similar bat designs are defied in U.S. Pat. No. 5,303,917, which discloses a two-member bat of thermoplastic and composite materials and U.S. Pat. No. 5,364,095, which discloses a two-member bat consisting of an external metal tube and an internal composite sleeve bonded to the inside of the external metal tube and running full length of the barrel portion of the bat.

U.S. Pat. No. 6,251,034 discloses a polymer composite second tubular member running throughout the full length of the barrel portion of the bat with the members joined at the ends only of the barrel portion with the balance of the composite member freely moveable relative to the primary member. U.S. Pat. No. 6,440,017 also discloses two member bats with an outer sleeve and inner shell of constant thickness running full length of the barrel portion. Other references include U.S. Pat. No. 6,287,222, U.S. Pat. No. 6,461,260, U.S. Pat. No. 6,425,836, and U.S. Publication 2002/0094892.

In all of the above-noted multi-walled tubular bats, the bat secondary member, or insert, extends along the entire frame barrel length, has constant diameter and thickness, resulting in uniform cross-sectional geometry along the secondary member length. Also, the bat members are not joined, except at their ends, in order to reduce radial stiffness of the barrel portion to improve bat performance. Also, in all cases, the radial stiffness of the barrel portion is uniform or constant throughout the full length of the barrel portion of the bats.

While the prior art single-wall, double-walled and multi-walled tubular bats have demonstrated improved performance as claimed, various regulatory bodies have raised safety concerns regarding improved performance bats and thus, some have established maximum performance standards for various categories of baseball bats under their jurisdiction. As a result, manufacturers of baseball bats are required to pass various controlled laboratory tests, such as, BBF (batted ball performance), BBS (batted ball speed), BBCOR (batted ball coefficient of restitution), all of which are designed with the intent of limiting bat performance as measured by hit distance. Further, for a given bat category (e.g. slow pitch softball), there may be two or more regulatory bodies, each of which may establish a different standard. Further, any of the regulatory bodies may change their standard from time to time. Such new or changed regulations are extremely problematic, costly, and disruptive for both manufacturers and players.

It is generally not desirable to lower the performance of a bat by simply increasing the thickness of the barrel wall of one or more of the barrel members along its full length. Lowering the performance of the bat by merely increasing the wall thickness can increase weight such that the finished bat weight objective is exceeded. On the other hand, it is desirable while meeting lowered bat performance standards, to improve player performance as opposed to bat performance by selectively locating the bat's sweet spot along its length and/or by creating a bifurcation, or two or more sweet spots along the bat barrel length.

Therefore, what is needed is a simple low-cost, low-weight-added invention to selectively, by design, locate the bat sweet spot along the bat barrel length or to create two or more sweet spots along the barrel length, which improves player performance while meeting mandated bat performance standards.

The sweet spot of a bat is generally the portion of the barrel, which when struck by the ball, provides maximum batting performance. It is the location on the barrel at which the bat-ball collision occurs with maximum efficiently and with the transmission of minimum vibration through the handle to the hands of a user. Maximum bat performance, as measured by hit distance, occurs at the middle or peak of the sweet spot area. The sweet spot is located approximately at the fundamental hoop mode's maximum amplitude, the antinode, and is located generally midway along the barrel portion of prior art tubular bats. It is highly desirable to provide improved player performance bats with either the sweet spot selectively located along the bat barrel length away from the barrel mid-point, or to create two or more sweet spots along the tubular bat barrel length. Both of these designs can improve player performance as opposed to bat performance, which is an objective of the present invention. Further, bats of the present invention having one or more a thin, lightweight internal diaphragms, besides improving player performance, meet regulated bat performance standards while providing a vibration free, soft feel and unique sound upon contact with a ball.

U.S. Publication 2005/0070384 addresses the creation of a larger sweet spot region by varying radial stiffness along the barrel length by adding a ring stiffener, or by changing fibre properties along the barrel length, or by thickening the barrel wall generally in the area of the sweet spot.

U.S. Publication 2011/0152015 addresses the objective of controlling bat performance by employing a central tube positioned coaxially within the barrel joined at the barrel end cap and including at least one restrictive member capable of limiting the bat performance.

U.S. Pat. No. 6,949,038 purports to achieve an improved sweet spot characteristic by providing a secondary member, located either inside or outside the barrel of a standard bat frame, wherein the secondary member has a constant outside diameter with an internal wall whose thickness increases while proceeding from its ends respectively inwardly towards the opposing ends. Generally, this thickening is shown to increase to a maximum around the mid-portion of the length of the secondary member. In FIG. 12, this thickness is shown to practically decrease the mid-portion of the length of the secondary member, providing two laterally placed regions of maximum thickness on either side of the mid-portion.

While prior constructions represent different means of limiting or reducing bat performance and/or achieving an enlarged sweet spot of a baseball bat, one objective is to improve player performance, as opposed to bat performance, by selectively relocating the sweet spot area or creating a bifurcation of the sweet spot resulting in two or more separate sweet spot areas along the bat barrel length. To achieve this objective, bats according to embodiments of the present invention have one or more thin lightweight diaphragms internally placed and selectively fastened within the bat's internal cavity.

SUMMARY OF THE INVENTION

Therefore, in view of the foregoing, what is needed are tubular baseball bats with specifically located sweet spots, or two or more sweet spots, both of which improve player performance while at the same time meeting regulated bat performance standards. To achieve these objectives, the bats according to embodiments of the present invention are stiffened at selected locations along the barrel length, which is achieved by one or more thin, lightweight diaphragms internally placed and selectively secured inside the bat's internal cavity, separating the bat's internal cavity into two or more separate internal cavities. The term diaphragm used herein means a thin, generally solid disc like device which may be of variable cross sectional geometry, positioned within the internal cavity of a hollow bat and spanning the entire cavity such that the diaphragm's outside circumferential diameter meets the bat's inside circumferential diameter, thus bifurcating the bat cavity.

The lightweight diaphragm may be made of any suitable material successfully utilized in the manufacture of tubular bats, including metals, polymers and composites, or combinations thereof, and is generally a thin, generally solid stiff disc, with an outside diameter approximating the inside diameter of the internal bat cavity, with a thickness in the order of 0.060 inches, and may be combined with a small flange or ring at the diaphragm's outer diameter to distribute local impact loads and provide fixturing or joining of the diaphragm to the barrel's internal surface. The diaphragm spans the entire internal cross section of the bat at the selected location or locations. The diaphragm joins or couples the impact side of the barrel wall to the entire circumference of the bat at the diaphragm location via in-plane, or membrane, stresses. The barrel wall cannot flex or has limited flex at the diaphragm location because the diaphragm prevents the circular barrel from distorting into an oval shape. The stiffness that the diaphragm imparts on the barrel wall is an order of magnitude higher than that achieved by flexural member stiffening and the effect is significantly more localized. The failure mode of the diaphragm structure is a plate buckling mode, which is controlled by the modulus (stiffness) of the material used, not the strength. Because the modulus of all aluminum alloys is virtually the same, regardless of the strength, this allows the use of lower quality alloys for an aluminum diaphragm than would be needed for an equivalent-weight flexural stiffener.

In a further embodiment, the diaphragm is supported by a flexible ring so that there is a small annular gap between the inside surface of the bat's internal cavity and the diaphragm. This allows the barrel to deform a predetermined amount into the annular gap before it contacts the diaphragm. The supporting structure can be a thin-walled aluminum ring or a solid but flexible polymer shape. This allows a predetermined amount of trampoline effect, which is useful for limiting bat performance to a degree, but without going to the extreme of reducing performance to the standard of a solid wood bat.

In another embodiment, the diaphragm may be configured into a shape that has a variable cross-section, thereby creating a small annular gap between the outer portion of the diaphragm and the inner portion of the diaphragm. This allows the barrel to deform a predetermined amount into the annular gap before it contacts the inner portion of the diaphragm. This again allows a predetermined amount of trampoline effect, which is useful for controlling bat performance.

The diaphragm can be used to alter the fundamental hoop mode shape, either to align the fundamental hoop mode peaks with the bending mode nodes (improving performance) or to separate the peaks of the fundamental hoop mode from the nodes of the bending mode (restricting performance). Locating the diaphragm in the bat taper region moves the fundamental hoop mode peak further outboard or towards the distal end of the bat barrel. The fundamental hoop mode of the bat without the diaphragm extends far into the taper region, causing the peak to be too far inboard to line up with the bending mode nodes. Inserting a diaphragm into the end of the taper forces the peak of the fundamental or first hoop mode outboard by an amount roughly equal to half the distance between the proximal end of the taper and the diaphragm. In this location, near the end of the taper, the diaphragm shifts the sweet spot nearer to the bat barrel distal end, thereby increasing player performance for ball contacts near this location, due to the faster bat swing speed.

Placing the diaphragm at or near the location of the bat's natural sweet spot without a diaphragm, divides the bat barrel cavity into two distinct barrel cavities. The original barrel without a diaphragm has a fundamental hoop mode containing one peak near the middle of the barrel, while the modified barrel with the diaphragm inserted at the location of the natural sweet spot has a fundamental hoop mode that has two peaks, at approximately halfway points between the diaphragm and either end of the barrel portion of the bat. This creates a hoop mode node at the diaphragm location and bifurcates the fundamental hoop mode since it doubles the number of peaks in the fundamental hoop mode, in effect creating two distinct sweet spots. The result is to increase the area along the bat barrel with maximum allowable bat performance resulting in improved player performance.

In accordance with one aspect then, there is provided a tubular bat for striking a ball, the bat comprising: a handle portion for gripping; a tubular barrel portion; a tubular taper portion connecting the handle portion and the barrel portion, wherein the barrel portion and the taper portion have an internal diameter and include an internal cavity and a bat wall having an inner surface and an outer surface; and at least one diaphragm located within the internal cavity, the at least diaphragm having a peripheral edge, the at least one diaphragm fastened at the peripheral edge to the inner surface of the bat wall, thereby dividing the internal cavity into at least two cavities.

In one embodiment, the diaphragm is a circular, disc-shaped diaphragm that spans the entire internal diameter of the bat. The diaphragm may have a thickness of between about 0.0625 inches and about 10% of the internal diameter of the bat. The diaphragm may have a weight of between about 0.18 ounces and about 3 ounces, a stiffness of at least 100 pound-inches, and a strength of at least 5,000 pounds per square inch. The diaphragm may be solid, or may include small openings to reduce weight. The diaphragm may be located approximately at the sweet spot of the bat or within the taper portion of the bat. The bat may include two diaphragms located with the internal cavity, thereby dividing the internal cavity into three cavities.

In accordance with another aspect, there is provided a tubular bat for striking a ball, the bat comprising: a handle portion for gripping; a tubular barrel portion; a tubular taper portion connecting the handle portion and the barrel portion, wherein the barrel portion and the taper portion have an internal diameter and include an internal cavity and a bat wall having an inner surface and an outer surface; and at least one diaphragm located within the internal cavity, the at least one diaphragm including a supporting ring having an inside surface and an outside surface, the inside surface of the supporting ring being attached to a peripheral edge of the at least one diaphragm, the outside surface of the supporting ring being fastened to the inner surface of the bat wall, thereby dividing the internal cavity into at least two cavities.

In one embodiment, an annular gap is located between the inner surface of the bat wall and the outer surface of the supporting ring so as to allow the bat wall to deform by a predetermined amount into the annular gap upon contact with the ball before contacting the diaphragm, thereby providing a limited trampoline effect.

In accordance with yet another aspect, there is provided a tubular bat for striking a ball, the bat comprising: a handle portion for gripping; a tubular barrel portion; a tubular taper portion connecting the handle portion and the barrel portion, wherein the barrel portion and the taper portion have an internal diameter and include an internal cavity and a bat wall having an inner surface and an outer surface; and at least one diaphragm or stiffening member located within the internal cavity, the at least one diaphragm or stiffening member having a peripheral edge mounted to the inner surface of the bat wall, thereby dividing the internal cavity into at least two cavities, wherein the at least one diaphragm or stiffening member comprises an outer U-shaped ring portion and an inner disc portion, and an annular gap located between the outer ring portion and the inner disc portion, wherein, in use, upon contact with the ball, the at least one diaphragm or stiffening member is configured to deform by a predetermined amount before its outer ring portion contacts its inner disc portion for providing a limited trampoline effect to the bat. The diaphragm may be located approximately at the sweet spot of the bat.

In accordance with a further aspect, there is provided a tubular bat for striking a ball, the bat comprising: a handle portion for gripping; a tubular barrel portion; a tubular taper portion connecting the handle portion and the barrel portion, wherein the barrel portion and the taper portion have an internal diameter and include an internal cavity and a bat wall having an inner surface and an outer surface; and at least one closed-end tubular insert located within the internal cavity, the at least one closed end tubular insert having at least one closed end, wherein the at least one closed end forms a diaphragm that spans the entire internal diameter of the bat, thereby dividing the internal cavity into at least two cavities. The at least one closed end may be located approximately at the sweet spot of the bat or within the taper portion of the bat. In one embodiment, the bat has two closed-end tubular inserts located within the internal cavity, each closed-end tubular insert having at least one closed end forming a diaphragm that spans the entire internal diameter of the bat. The closed ends may be located adjacent one another or they may be separated by a pre-determined distance. In a further embodiment, at least one open-ended tubular insert may also be located within the internal cavity along with the closed-end tubular insert, the open-ended tubular insert having two open ends.

The foregoing summarizes the principal features of the present invention and some of its optional aspects. The invention may be further understood by the description of the preferred embodiments, in conjunction with the drawings, which follow.

DETAILED DESCRIPTION OF THE EMBODIMENTS

Figure 1:
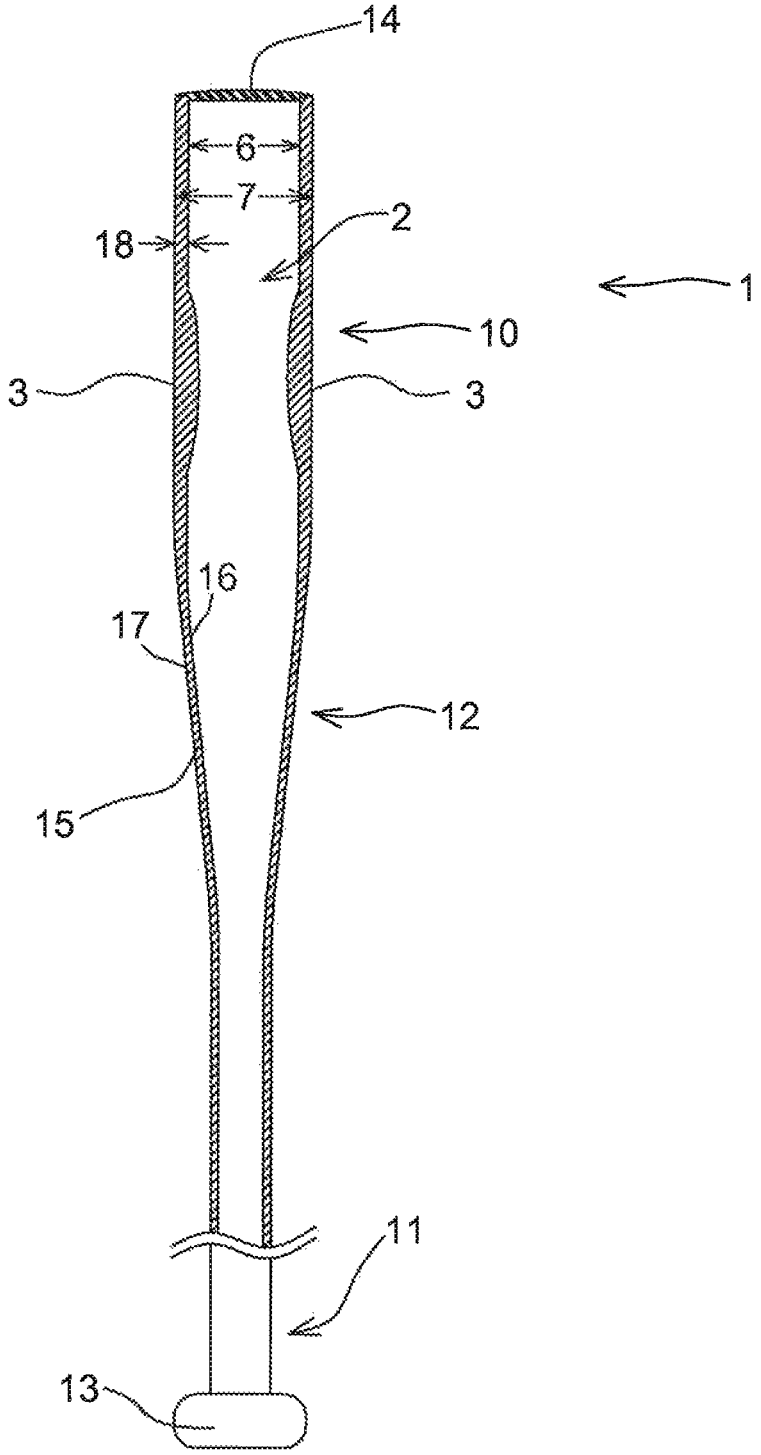
FIG. 1 (PRIOR ART)
FIG. 1 shows a longitudinal cross-section of a typical single wall tubular bat of the prior art, with a thickened barrel wall in the bat's sweet spot area.

FIG. 1 shows a typical baseball bat 1 of the prior art, having a barrel portion 10, a handle portion 11, and a taper region 12, connecting the barrel portion to the handle portion. A knob 13 fits into the proximal end of the handle portion 11, and an end cap 14, fits into the distal end of the barrel portion 10. The bat 1 has a bat wall 15 having an internal surface 16, and an external surface 17, forming an internal cavity 2. The bat wall 15 has an internal diameter 6 and an external diameter 7, both of which may vary along the length of the bat. The bat wall 15 has a wall thickness 18, which may also vary along the length of the bat. Such bats will generally have a sweet spot 3 located midway between the distal end 14 of the bat and the spot where the taper portion 12 meets the barrel portion 10. Aluminum bats that pass the BBCOR test can be made by simply increasing the thickness 18 of the bat wall 15 in the barrel area 10 near the sweet spot 3 as shown in FIG. 1. Increasing the barrel wall thickness 18 enough to pass the BBCOR test has several drawbacks: 1) the performance is decreased in areas away from the sweet spot, 2) the extra weight added to the barrel makes the bat much harder to swing quickly, thereby reducing performance, and 3) the extra material results in a higher manufacturing cost.

The barrel stiffness of bats made with composite laminates can be increased by also increasing the bat wall thickness 18 in the area of the sweet spot 3 or by changing the type and direction of the fibers in the barrel portion 10. Unfortunately, the same drawbacks are encountered when designing composite bats to pass the BBCOR test as are encountered with aluminum bats, and the cost increase is an order of magnitude higher due to the higher cost of the stiffer carbon fibers required.

Figure 2A:
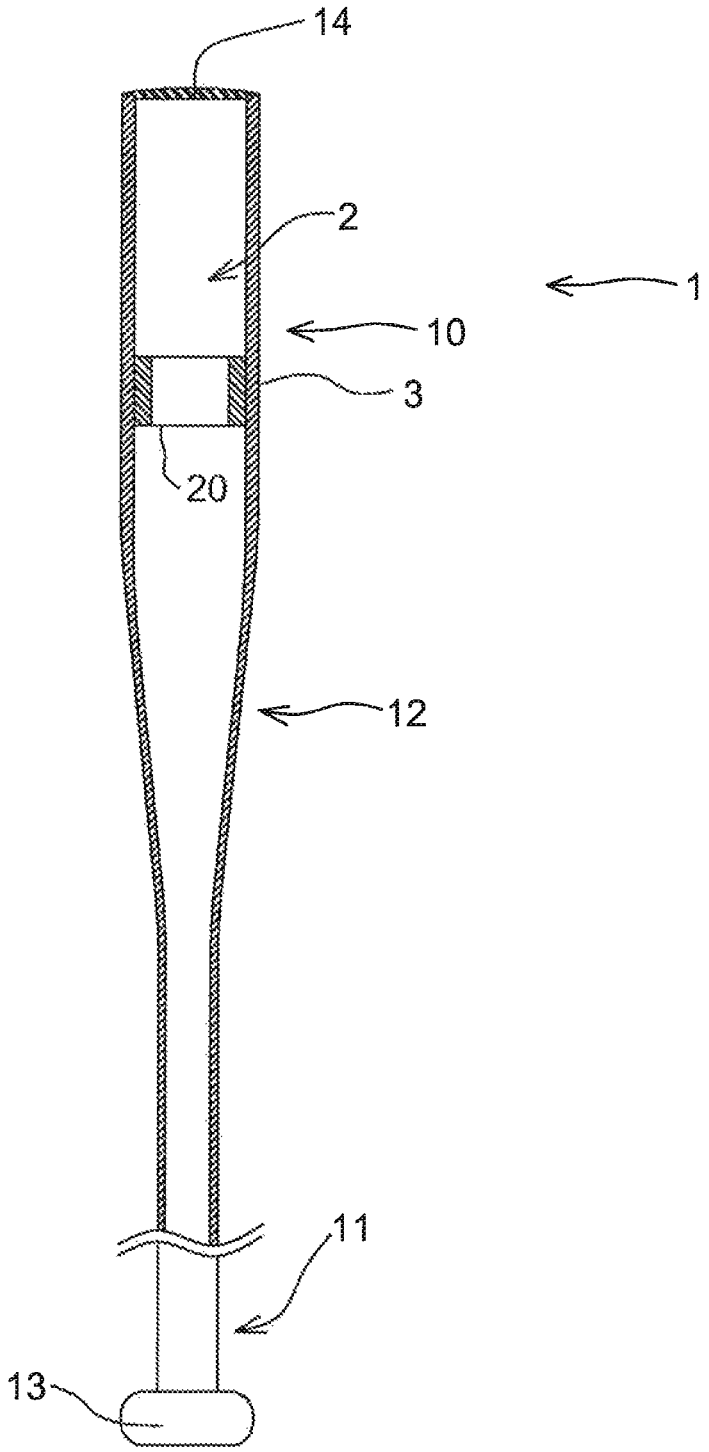
FIG. 2a (PRIOR ART)
FIG. 2*a* shows a longitudinal cross-section of a typical single wall tubular bat of the prior art with a ring shaped stiffener in the bat's sweet spot area.

FIG. 2*a* shows a second approach to designing a hollow bat that has a minimal trampoline effect. A local stiffener in the form of a ring 20 is inserted into the barrel portion 10 at the sweet spot 3. This reduces the performance locally while still allowing the barrel to flex away from the stiffener. The stiffening ring 20 required to accomplish this has to have significant flexural strength and stiffness, and is therefore as heavy as the added weight required when thickening the barrel wall, as described above.

Figure 2B:
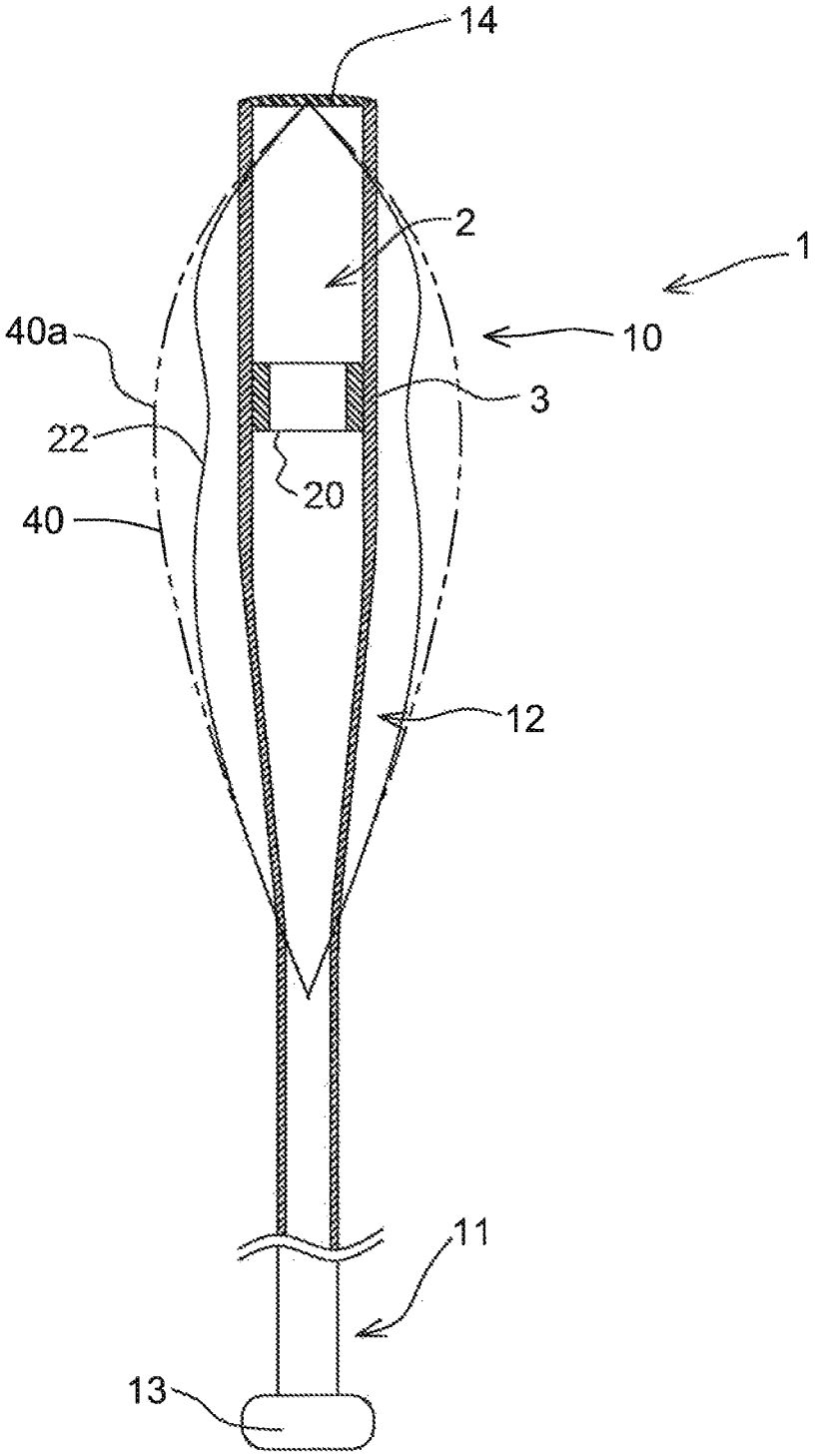
FIG. 2b (PRIOR ART)
FIG. 2*b* is a longitudinal cross-section of the bat shown in FIG. 2, showing the effect the ring shaped stiffener has on the bat barrel fundamental hoop mode.

As shown in FIG. 2*b* the original bat barrel 10, without the ring 20, has a fundamental hoop mode 40 containing one peak 40*a* located near the middle of the barrel, approximately at the sweet spot 3. Once the ring 20 is inserted, a modified hoop mode 22 is created. The deflection of the modified hoop mode 22 is reduced but not eliminated at the location of the ring 20. This results in a reduced trampoline effect at the sweet spot area, but does not eliminate the trampoline effect at that location.

To overcome the problems of stiffening too wide of an area of the bat and adding too much weight, a more efficient and localized stiffening solution is required. The fundamental problem with all of the prior solutions is that they attempt to stiffen the barrel wall by adding material that resists deformation via flexural stresses. The fact that this material must flex requires that it have high flexural yield strength, resulting in the required use of high strength materials that tend to be costly.

Figures 3A, 3B:
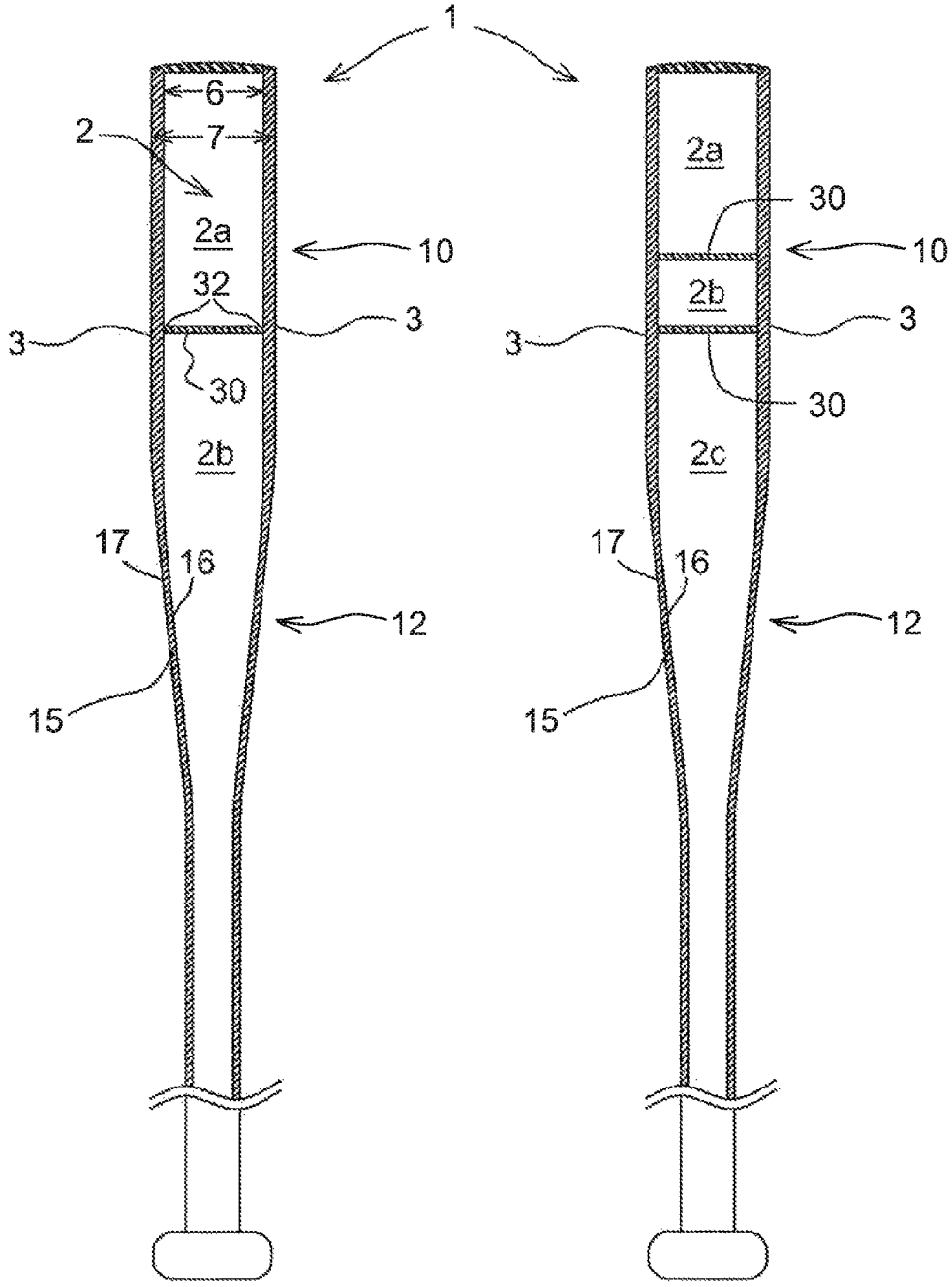
FIG. 3*a* shows a longitudinal cross-section of one embodiment of the present invention showing a single wall tubular bat having an internal diaphragm located at the bat sweet spot area.
FIG. 3*b* shows a longitudinal cross-section of the same bat shown in FIG. 3*a*, having two internal diaphragms located within the bat barrel portion of the bat.

The present solution, as described herein below, is directed to providing tubular baseball bats with a bifurcated or relocated sweet spot to improve player performance, as opposed to bat performance, while meeting any regulated bat performance standards. As shown in FIG. 3*a*, this is accomplished by selectively placing a thin, stiff, lightweight diaphragm 30 within the bat's internal cavity 2, with the diaphragm 30 fastened at the periphery of its outside circumference 32 to the internal surface 16 of the tubular bat cavity 2, spanning the entire internal diameter 6 of the bat, thus separating the single bat cavity 2 into two separated cavities 2*a* and 2*b*.

The term diaphragm, as describe herein means, a relatively thin, stiff, lightweight, predominantly solid circular device, which when located within the bat cavity 2 at or near the sweet spot 3, as described above, results in bifurcation of the original bat's sweet spot, thereby resulting in improved player performance while meeting any regulated bat performance standards. The diaphragm may be disc-shaped, or may have a variable cross-section, as further described below.

The term sweet spot as used in this disclosure refers to the area along the tubular bat barrel length 10, in the range of 2" to 4" in length, normally centered in the middle of the bat barrel length at a location 3 (see FIG. 1) where bat performance, as measured by hit distance, is at the maximum. The sweet spot 3 is the location of maximum deformation of the tubular bat barrel 10 caused by a ball impact and rebound, which results in the maximum trampoline effect. The maximum trampoline effect occurs at the middle of the sweet spot 3, which corresponds approximately to the maximum amplitude of the fundamental or first hoop mode of vibration of the bat. Tubular softball bats have a fundamental first hoop mode frequency typically in the range of 500 to 1800 hertz, while baseball bats typically have a fundamental first hoop mode frequency in the range of 2000 to 4000 hertz.

Referring again to FIG. 3*a*, the diaphragm 30 couples the outer surface or impact side 17 of the bat wall 15 to the entire circumference of the bat at the location of the diaphragm via in-plane, or membrane stresses. The bat wall 15 cannot flex at this point because the diaphragm 30 prevents the circular bat wall 15 from distorting into an oval shape. The stiffness that the diaphragm 30 imparts to the bat wall 15 is an order of magnitude higher that that achieved by flexural membrane stiffening, and the effect is significantly more localized.

In one example, which was successfully field-tested by the inventors, an aluminum diaphragm was used in a bat having an outside barrel diameter 7 of $2^{5/8}$ inches. In this example, the diaphragm weighed 2 ounces, was a circular disc having a thickness of 0.050 inches, a strength of 45,000 pounds per square inch (psi) and a stiffness of 108 lb-in. In another example, with a bat having an outside barrel diameter 7 of $2^{1/4}$ inches, both weight and stiffness of a disc-shaped diaphragm were correspondingly lower. By utilizing a carbon composite diaphragm, the thickness of a disc-shaped diaphragm was reduced to 0.0625 inches with a weight of as low as 0.18 ounces. Testing has shown that a disc-shaped diaphragm may weigh between 0.18 and 3 ounces with a thickness of between 0.0625 inches and 10% of the bat's internal diameter, which for example is approximately 0.200 inches for $2^{1/4}$ inch barrel diameter bats employed in slow pitch, fast pitch, and youth baseball, and 0.225 inches for $2^{5/8}$ inch barrel diameter bats employed in senior league and adult baseball.

The failure of a disc-shaped diaphragm from ball impact is plate-buckling mode, which is controlled by the modulus (stiffness) of the material used, not the strength. Since the modulus of all aluminum alloys is virtually the same, regardless of the strength, this allows the use of lower cost alloys to be used in the manufacture of diaphragms than would be needed for an equivalent-weight flexural stiffener.

The diaphragm 30 may be made of any suitable material, provided that the product of the material's modulus, specified in pounds per square inch (psi), and the second moment of area of the thinnest section, specified in inches cubed, is at least 100 lb-in. The second moment of area (SMA) of the central portion of a thin flat disc is defined here as $$SMA=thickness^3/12$$

such that the stiffness requirement is expressed as $$20\ Modulus\times Thickness^3/12>=100\ lb\text{-}in.$$

In addition, the ultimate strength of the material should be at least 5,000 psi, with a weight of between 0.18 ounces and 3 ounces. While generally solid, the diaphragm 30 may include small openings to further reduce weight while not unduly lowering the diaphragm stiffness.

FIG. 3*b* shows the same bat 1 as shown in FIG. 3*a*, having two diaphragms 30 positioned and secured within the barrel portion 10. Each diaphragm 30 is configured into the same shape as that shown in FIG. 3*a*, each diaphragm 30 spanning the entire internal diameter 6 of the bat, thus separating the single bat cavity 2 into three separated bat cavities 2*a*, 2*b* and 2*c*. The diaphragms 30 may both be located in the barrel portion 10 as shown in FIG. 3*b*, or one diaphragm 30 may be located in the barrel portion 10 with the other diaphragm 30 located in the taper portion 12, as described below with reference to FIG. 6.

Figure 4:
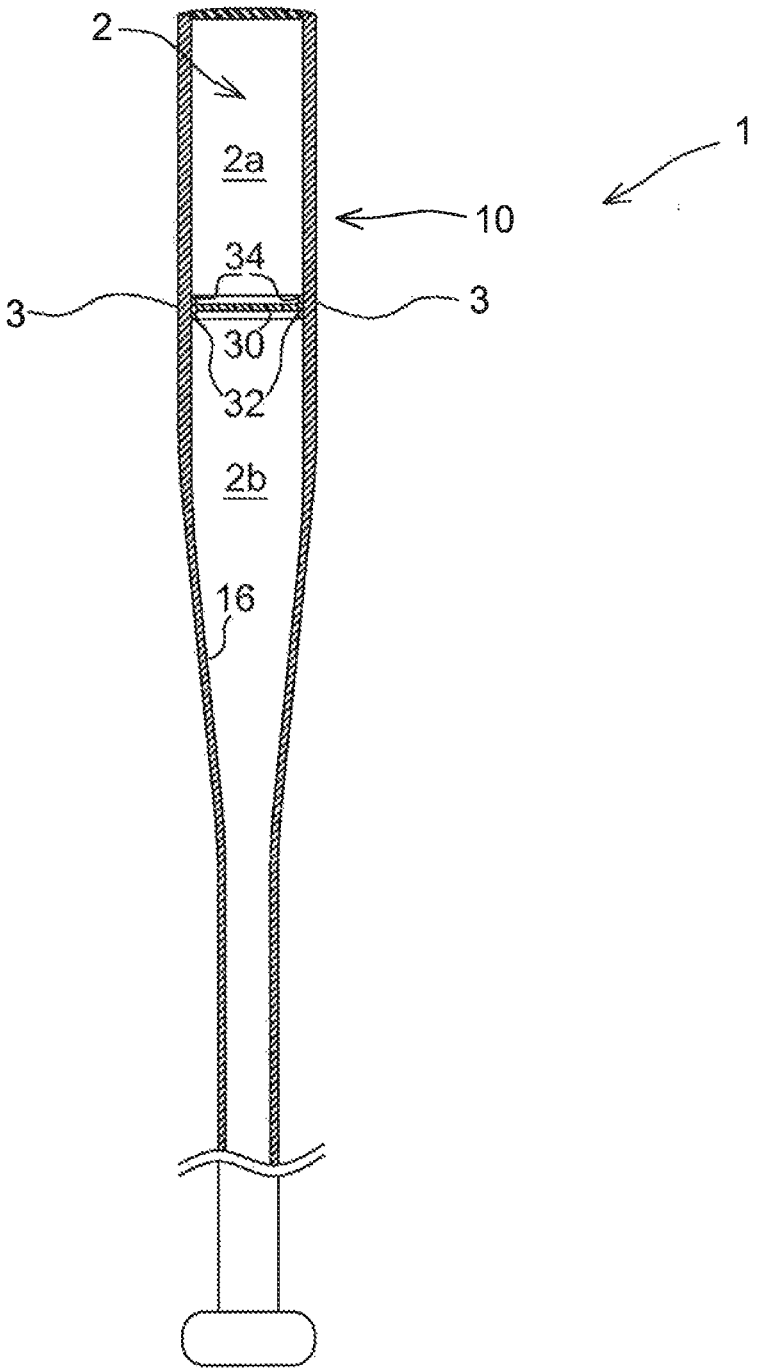
FIG. 4 shows a longitudinal cross-section of another embodiment, showing a single wall tubular bat having an internal diaphragm located at the bat sweet spot area, the diaphragm having an integral supporting ring for attachment of the diaphragm to the inside surface of the bat cavity.

As shown in FIG. 4, the diaphragm 30 may have a supporting integral ring 34, having a width somewhat greater than the diaphragm thickness. Ring 34 is used to securely fasten or join the diaphragm 30 to the inside surface 16 of the tubular bat wall 15 at the diaphragm's periphery 32. The outside surface of the ring 34 that comes in contact with the inside surface 16 of the bat wall 15, may be smooth, or may be roughened or grooved to facilitate joining to the tubular bat 1.

Figure 5:
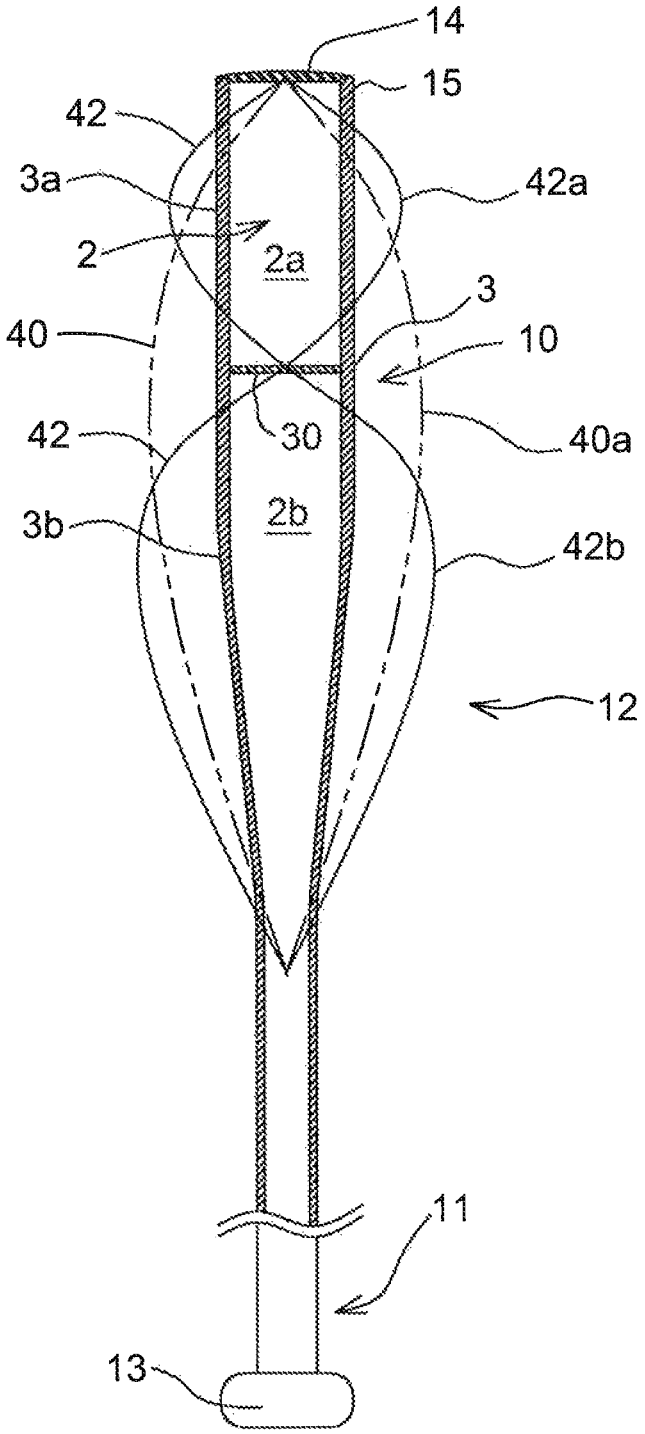
FIG. 5 is a longitudinal cross-section of the bat shown in FIG. 3*a* showing the resultant bifurcation of the bat barrel fundamental hoop mode resulting in two distinct sweet spots.

As shown in FIG. 5, locating a single diaphragm 30 internally within the bat cavity 2 at or near the sweet spot 3 results in a bifurcation of the tubular bat's internal cavity 2 into two separate bat cavities 2*a*, 2*b*. The original bat barrel 10, without the diaphragm 30, has a fundamental hoop mode 40 containing one peak 40*a* located near the middle of the barrel approximately at the sweet spot 3. Once the diaphragm 30 is inserted and secured to the inner surface 16 of the bat wall 15, the hoop mode of the bat is modified. As shown in FIG. 5, a first modified hoop mode 42 has two peaks 42*a* and 42*b*, thus creating two separate sweet spots 3*a* and 3*b*, the first located towards the distal end 14 of the tubular bat barrel 10 and the second located towards the taper portion 12. The deflection of the modified hoop mode 42 is reduced to zero at the location of the diaphragm 30. This virtually eliminates the trampoline effect at the original sweet spot 3. The result is improved player performance by increasing the area of maximum bat performance along the length of bat barrel 10.

Figure 6:
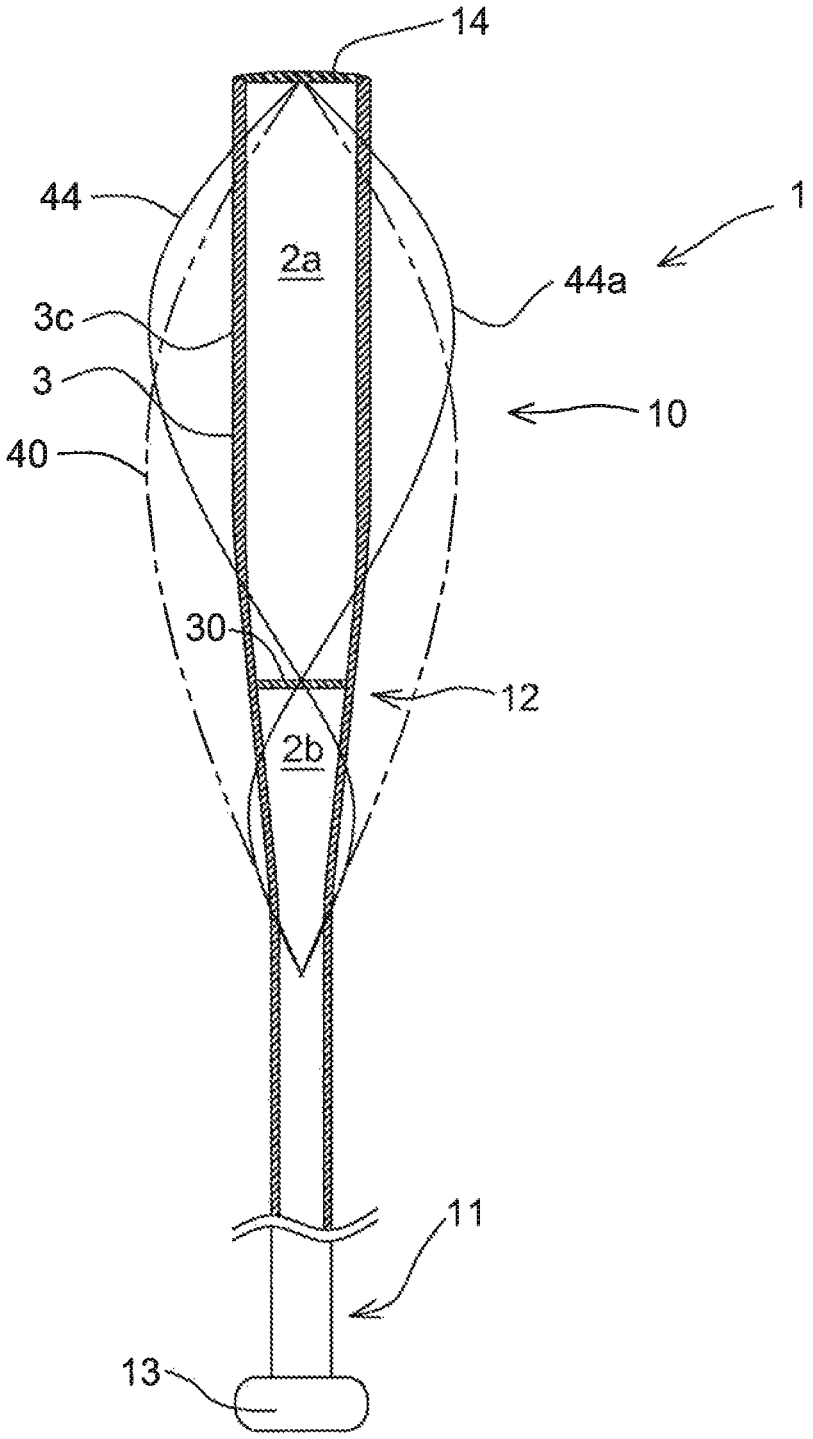
FIG. 6 shows a longitudinal cross-section of a further embodiment, showing a single wall tubular bat having an internal diaphragm located in the bat internal taper area and the resultant selective relocation of the peak of the bat barrel fundamental hoop mode (approximately concurrent with the bat's sweet spot) towards the bat barrel distal end.

Locating diaphragm 30 away from the sweet spot area 3 of the tubular bat 1 can produce alternative player performance improvements. For example, as shown in FIG. 6, locating diaphragm 30 in the tubular bat taper region 12 causes the fundamental hoop mode 40 to be modified, creating a second modified hoop mode 44. This modification results in a modified sweet spot 3*c*, which generally corresponds to the peak 44*a* of the second modified fundamental hoop mode 44, being moved towards the distal end 14 of bat barrel 10, resulting in improved player performance when impacting a ball in this area due to the correspondingly faster bat swing speed at this location.

Figure 7:
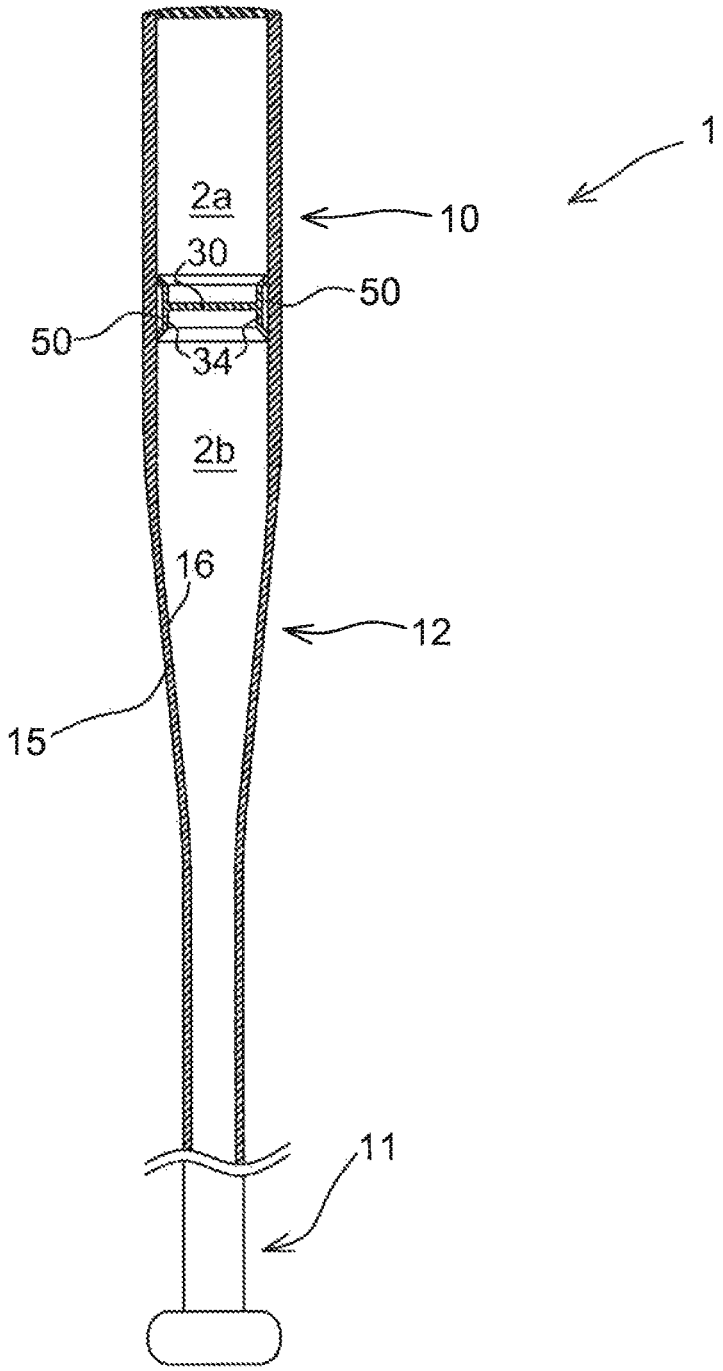
FIG. 7 shows a longitudinal cross-section of a further embodiment showing a single wall tubular bat having an internal diaphragm with an annular gap between the bat barrel inner wall surface and the diaphragm thus allowing limited deformation of the barrel upon ball contact until the barrel inner wall surface contacts the diaphragm.

A further way to improve player performance, as shown in FIG. 7, is to include an annular gap 50 between the supporting integral ring 34 of diaphragm 30 and the inner surface 16 of the bat wall 15. The annular gap 50 allows the bat barrel 10 to deform by a predetermined amount before it contacts the diaphragm 30. This provides a limited trampoline effect and thus improves player performance during initial contact while limiting bat performance to a desired amount once the annular gap 50 compresses upon ball impact, thus ensuring any applicable bat standard is not exceeded.

Figure 8A:
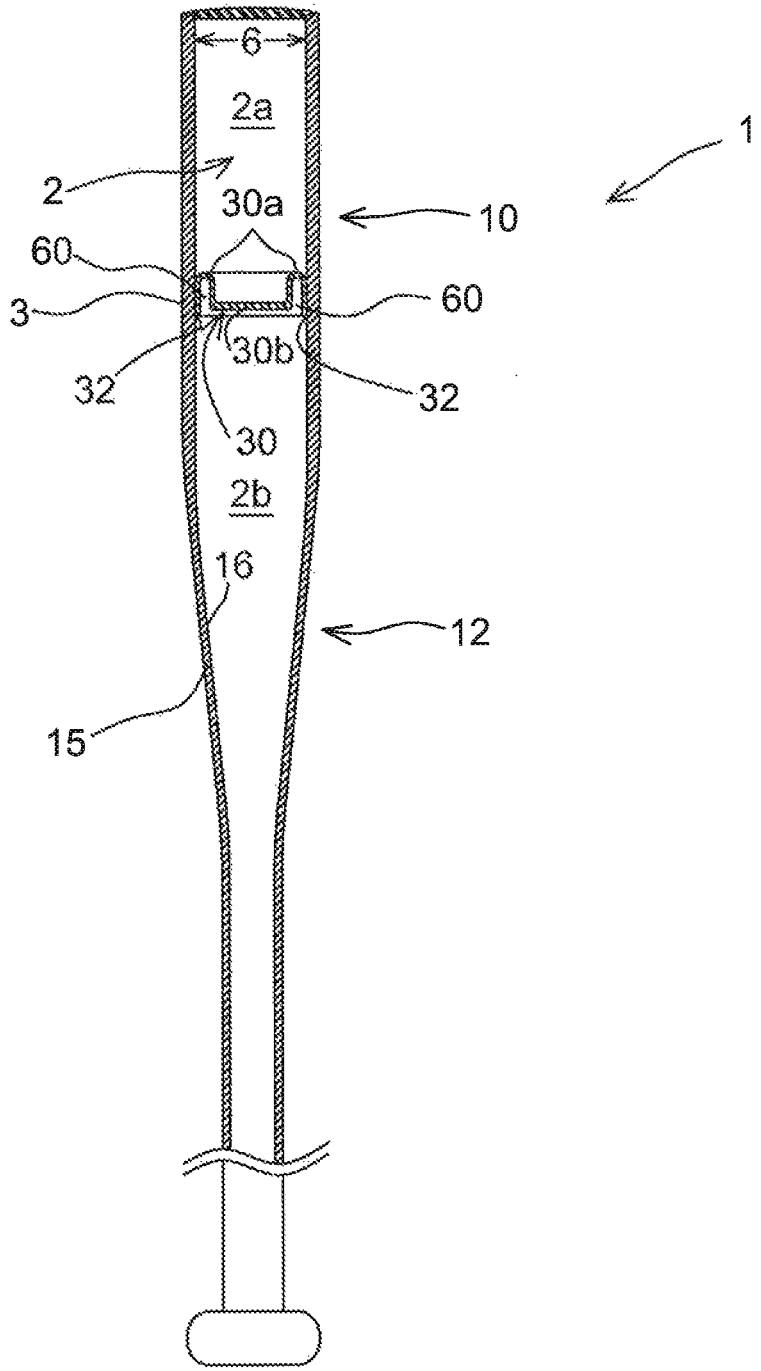
FIG. 8*a* shows a longitudinal cross-section of a further embodiment showing a single wall tubular bat having an internal diaphragm configured into a shape that has a variable cross-section, thereby creating an annular gap between the outer portion of the diaphragm and the inner portion of the diaphragm, thus allowing limited deformation of the barrel upon ball contact until the outer portion of the diaphragm contacts the inner portion of the diaphragm.

In another embodiment, as shown in FIG. 8*a*, the diaphragm 30 may be configured into a shape that has a variable cross-section, thereby creating a small annular gap 60 between an outer U-shaped ring portion 30*a* of the diaphragm and an inner disc portion 30*b* of the diaphragm 30. The outer portion 30*a* of diaphragm 30 is fastened at the periphery of its outside circumference 32 to the internal surface 16 of the tubular bat cavity 2, spanning the entire internal diameter 6 of the bat, thus separating the single bat cavity 2 into two separated cavities 2*a* and 2*b*. In this configuration, diaphragm 30 allows the barrel 10 to deform inward a predetermined amount until the outer U-shaped ring portion 30*a* of diaphragm 30 encounters the inner disc portion 30*b* of the diaphragm 30. This again allows a predetermined amount of trampoline effect, which is useful for controlling bat performance.

Figure 8B:
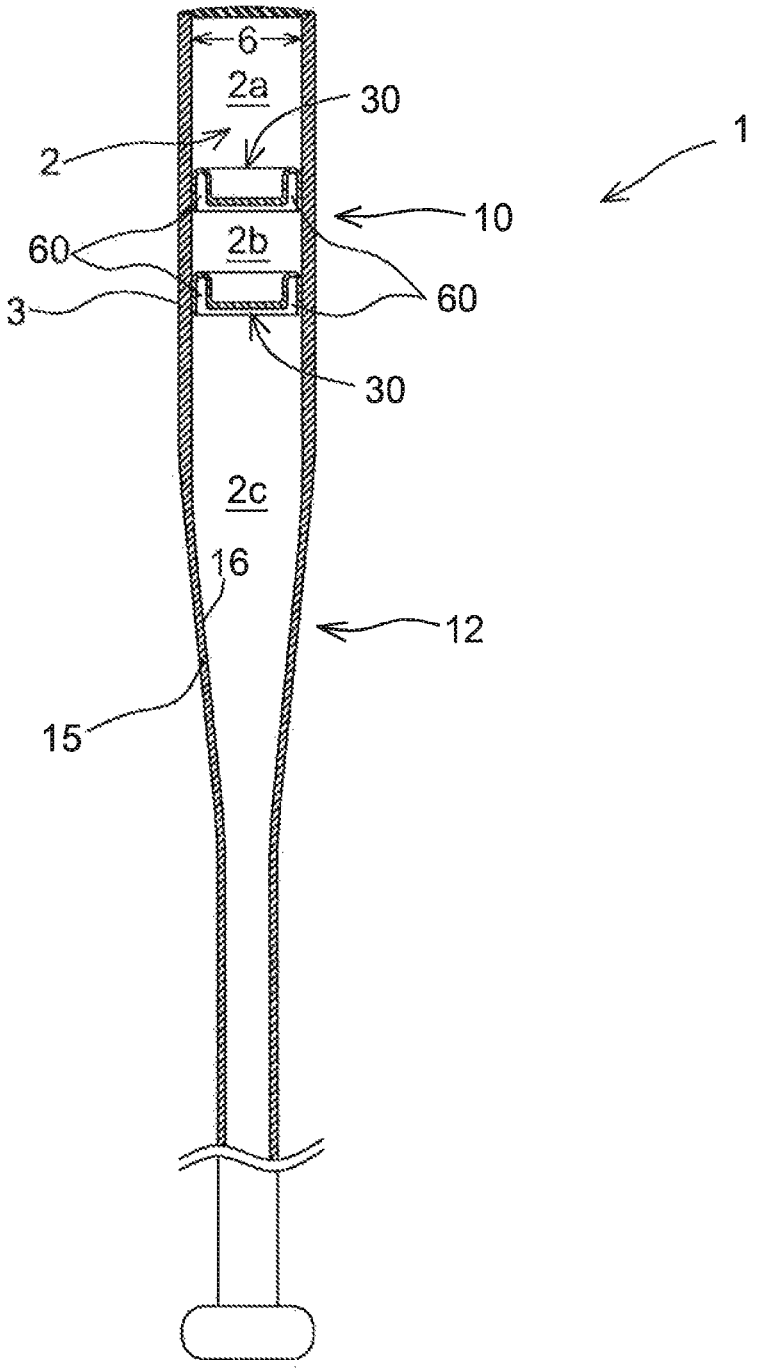
FIG. 8*b* shows a longitudinal cross-section of the same bat shown in FIG. 8*a*, having two internal diaphragms located within the bat barrel portion of the bat.

FIG. 8*b* shows the same bat 1 as shown in FIG. 8*a*, with two diaphragms 30 positioned and secured within the barrel portion 10 of the bat. Each diaphragm 30 is configured into the same shape as shown in FIG. 8*a*, having a variable cross-section, creating a small annular gap 60 between outer U-shaped ring portion 30*a* and inner disc, portion 30*b*. The diaphragms 30 span the entire internal diameter 6 of the bat, thus separating the single bat cavity 2 into three separated cavities 2*a*, 2*b* and 2*c*. Diaphragms 30 allow the barrel 10 to deform inward a predetermined amount until the outer U-shaped ring portions 30*a* of diaphragm 30 encounter the inner disc portions 30*b* of the diaphragms 30. This again allows a predetermined amount of trampoline effect, which is useful for controlling bat performance. The two diaphragms 30 my both be located in the barrel portion 10 as shown in FIG. 8*b*, or one diaphragm 30 may be located in the barrel portion 10 with the other diaphragm 30 located in the taper portion 12.

Moreover, it is understood that it may be advantageous to combine different configurations of diaphragms 30 at different locations within the internal cavity 2 of bat 1 to further control bat performance and improve player performance. For example, disc-shaped diaphragms, as shown in FIGS. 3*a*, 4, and 7, may be combined with variable cross-section diaphragms, as shown in FIG. 8*a*. All diaphragms may be located in the barrel portion 10 or the taper portion 12, or one type of diaphragm may be located in the taper portion 12 and the other type of diaphragm located in the barrel portion 12. Other possible combinations of diaphragms 30 are contemplated as well.

Figure 9A:
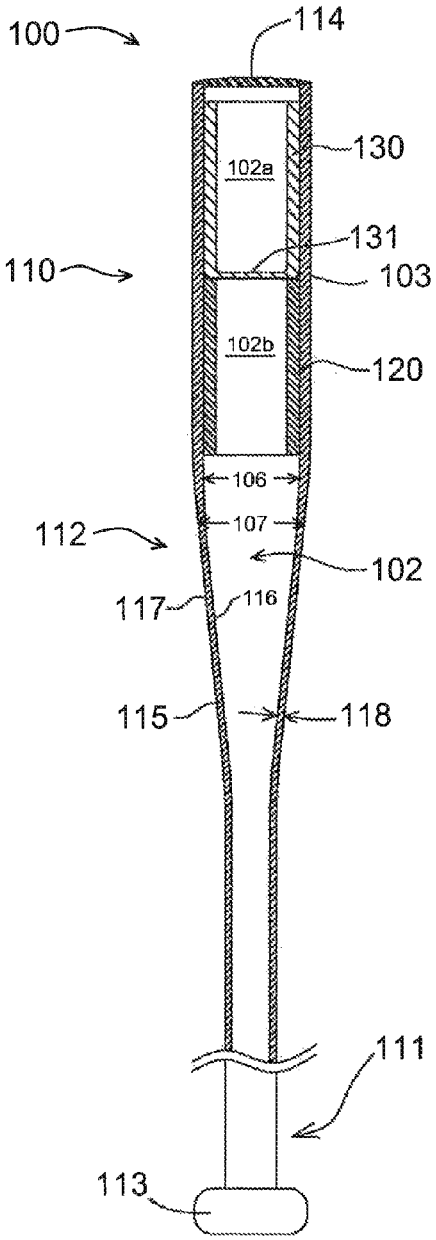
FIG. 9*a* shows a longitudinal cross-section of another embodiment showing a bat having an internal diaphragm located at or near the sweet spot area of the bat, where the diaphragm is formed by the closed end of a closed-end tubular insert.
Figure 9B:
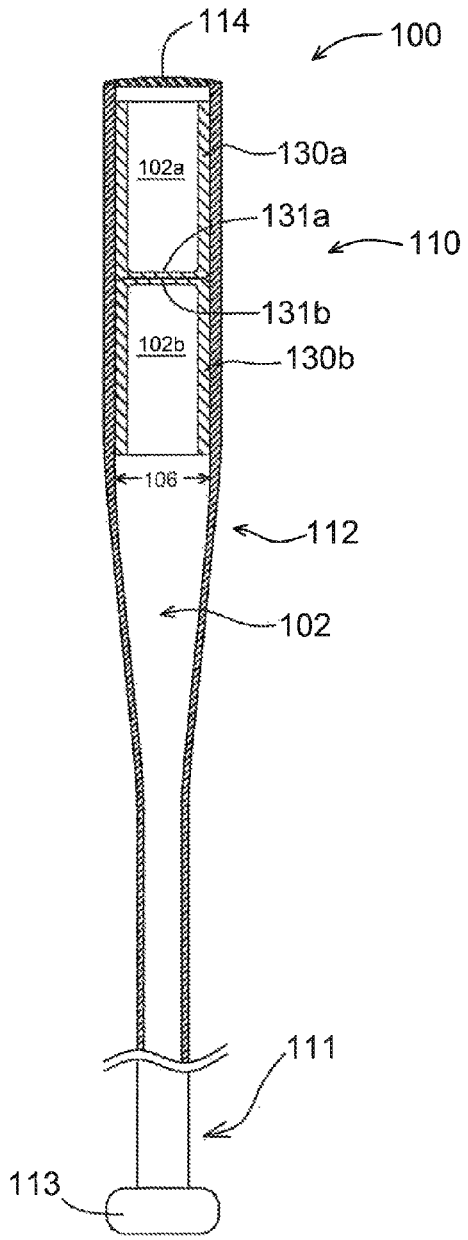
FIG. 9*b* shows a longitudinal cross-section of a further embodiment showing a bat having two internal diaphragms located at or near the sweet spot area of the bat, where each diaphragm is formed by the closed end of a closed-end tubular insert, and the diaphragms are positioned adjacent one another.
Figure 9C:
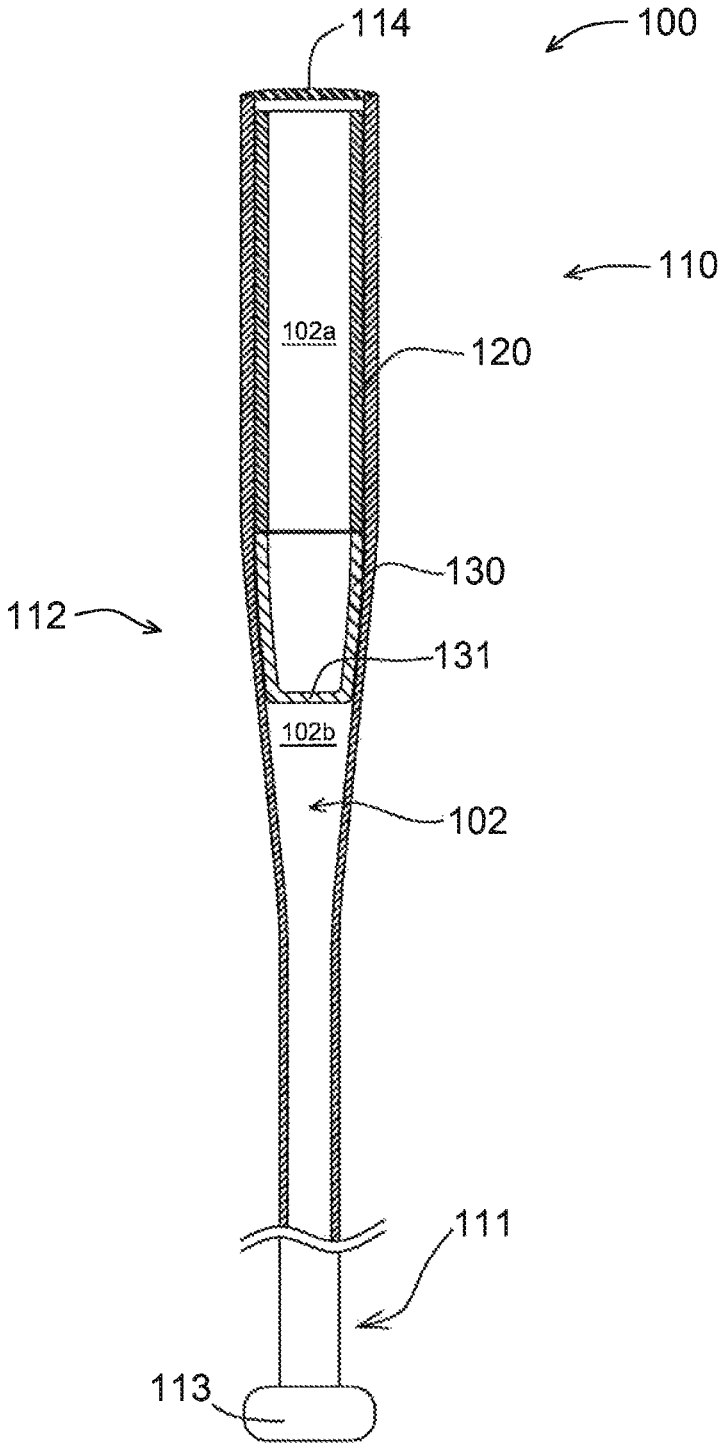
FIG. 9*c* shows a longitudinal cross-section of another embodiment showing a bat having an internal diaphragm located in the taper portion of the bat, where the diaphragm is formed by the closed end of a closed-end tubular insert.

FIGS. 9*a*, 9*b* and 9*c* show further embodiments in a bat 100, where a diaphragm 131 is formed by the closed end of a closed-end tubular insert 130. In the embodiment shown in FIG. 9*a*, the bat 100 includes a barrel portion 110, a handle portion 111, and a taper region 112, connecting the barrel portion to the handle portion. A knob 113 fits into the proximal end of the handle portion 111 and an end cap 114 fits into the distal end of the barrel portion 110. The bat 100 has a first bat wall 115 having an internal surface 116, and an external surface 117, forming an internal cavity 102. The first bat wall 115 of the bat has an internal diameter 106 and an external diameter 107, both of which may vary along the length of the bat. The bat's first wall 115 has a wall thickness 118, which may also vary along the length of the bat. A sweet spot 103 will generally be located midway between the distal end 114 and the spot where the taper portion 112 meets the barrel portion 110. An open-ended tubular insert or ring 120 having two open ends may be located within the internal cavity 102 of the bat in the proximal end of the barrel portion 110, and the closed end tubular insert 130 may be located within the internal cavity 102 in the distal end of the barrel portion 110. The inserts 120 and 130 may be located adjacent one another, as shown in FIG. 9*a*, thereby creating a double-walled barrel portion of the bat 100. The closed-end of the closed-end tubular insert 130 forms the diaphragm 131 that spans the entire internal diameter 106 of the bat, thereby separating the single bat cavity 102 into two separated cavities 102*a* and 102*b*.

The combination of inserts 120 and 130 create a bat 100 with a double-walled barrel portion 110 that has the advantage of also including diaphragm 131 spanning the entire internal diameter of the bat resulting in all of the same advantages described above with respect to a single walled bat having a diaphragm 30, as shown in FIGS. 3*a*, 4, 5, 6 and 7. In the same manner as described above for a single-walled bat, if the diaphragm 131 is located at or near the sweet spot 103 of bat 100, as shown in FIG. 9*a*, the result will be a bifurcation of the original bat's sweet spot, thereby resulting in two sweet spots and providing improved player performance while meeting any regulatory bat performance standards.

The advantage of using closed-end tubular insert 130 to create diaphragm 131 in the double walled bat 100 is a reduction of weight, assembly time and costs. Since the diaphragm 131 is formed by the closed end of closed-end tubular insert 130, it does not have to be glued in place, saving both assembly time and cost. In addition, there is improved reliability, since there is no risk of the diaphragm coming loose.

In a further embodiment, as shown in FIG. 9*b*, two closed-end tubular inserts 130*a* and 130*b* are located within the internal cavity 102 of the barrel portion 110 of bat 100, with their respective closed ends 131*a* and 131*b* located adjacent one another. The closed ends 131*a* and 131*b* each form a diaphragm that spans the entire internal diameter 106 of the bat, thereby separating the single bat cavity 102 into two separate cavities 102*a* and 102*b*. Alternatively, the two closed ends 131*a* and 131*b* may be separated by a predetermined distance.

In a further alternative embodiment, as shown in FIG. 9*c*, the closed-end tubular insert 130 is located within the internal cavity 102 of the bat, in the proximal end of the barrel portion 110, and the open-end tubular insert or ring 120 is located within the internal cavity 102, in the distal end of the barrel portion 110. In this configuration, the close end of the tubular insert 130, forming the diaphragm 131, is located in the taper portion 112 of the bat. The combination of inserts 120 and 130 create a bat 100 with a double-wall in the barrel portion 110 and part of the taper portion 112, that has the advantage of also including diaphragm 131 spanning the entire internal diameter of the bat in the taper portion 112 resulting in all of the same advantages described above with respect to a single walled bat having a diaphragm 30 located in the taper portion 12 as shown in FIG. 6. In the same manner as describe above for a single-walled bat, locating the diaphragm 131 in the taper portion 112, causes the fundamental hoop mode of the bat to be modified, creating a second modified hoop mode with a peak thereof being moved towards the distal end 114 of bat barrel 100, resulting in improved player performance when impacting a ball in this area due to the correspondingly faster bat swing speed at this location.

The previous detailed description is provided to enable any person skilled in the art to make or use the present bat with bifurcated internal cavities. Various modifications to the embodiments described will be readily apparent to those skilled in the art, and the generic principles defined herein may be applied to other embodiments without departing from the scope of the bat with bifurcated internal cavities as defined by the appended claims. Thus, the present bat with bifurcated internal cavities is not intended to be limited to the embodiments shown herein, but is to be accorded the full scope consistent with the appended claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A tubular bat for striking a ball, the bat comprising:

a handle portion configured to be held by a player;

a tubular barrel portion configured to strike the ball, the tubular barrel portion having a bat wall having an inner surface and an outer surface and defining an internal cavity with an internal diameter;

a tubular taper portion connecting the handle portion and the barrel portion; and at least one diaphragm located within the internal cavity, the at least one diaphragm having a peripheral edge mounted to the inner surface of the bat wall, thereby dividing the internal cavity into at least two cavities, the at least one diaphragm comprising an outer U-shaped ring portion and an inner disc portion, the U-shaped ring portion forming an annular gap located between the inner surface of the barrel and the inner disc portion;

wherein, in use, upon contact with the ball, the at least one diaphragm is configured to deform by a predetermined amount before an outer wall of the U-shaped ring portion contacts the inner disc portion for providing a limited trampoline effect to the bat.

2. The tubular bat of claim 1, wherein a radial compression force required to deform the bat wall near the at least one diaphragm increases by at least 100 lb/in when the outer wall of the U-shaped ring portion of the at least one diaphragm contacts the inner disc portion.

3. The tubular bat of claim 1, wherein the at least one diaphragm has a weight between about 0.18 ounces and about 3 ounces.

4. The tubular bat of claim 3, wherein the at least one diaphragm has a weight between about 0.5 ounces and about 2 ounces.

5. The tubular bat of claim 1, wherein the disc portion of the at least one diaphragm has a flexural bending stiffness of at least 100 pound-inches.

6. The tubular bat of claim 1, wherein the disc portion of the at least one diaphragm has a strength of at least 5,000 pounds per square inch.

7. The tubular bat of claim 1, wherein the at least one diaphragm is a first diaphragm located within the internal cavity and wherein the bat has a second diaphragm located within the internal cavity and spaced apart from the first diaphragm.

8. The tubular bat of claim 1, wherein the peripheral edge of the at least one diaphragm is fastened to the inner surface of the bat wall.

9. A tubular bat for striking a ball, the bat comprising:

a handle portion configured to be held by a player;

a tubular barrel portion configured to strike the ball, the tubular barrel portion having a bat wall having an inner surface and an outer surface and defining an internal cavity with an internal diameter;

a tubular taper portion connecting the handle portion and the barrel portion; and a diaphragm located within the internal cavity, the diaphragm having a peripheral edge fastened to the inner surface of the bat wall, thereby dividing the internal cavity into at least two cavities, the diaphragm comprising an outer U-shaped ring portion and an inner disc portion, the U-shaped ring portion forming an annular gap located between the inner surface of the barrel and the inner disc portion;

wherein, in use, upon contact with the ball, a radial compression force required to deform the barrel wall near the diaphragm increases by at least 100 lb/in when an outer wall of the U-shaped ring portion of the diaphragm contacts the inner disc portion such that the diaphragm provides a limited trampoline effect to the bat.

10. The tubular bat of claim 9, wherein the diaphragm has a weight between about 0.18 ounces and about 3 ounces.

11. The tubular bat of claim 10, wherein the diaphragm has a weight between about 0.5 ounces and about 2 ounces.

12. The tubular bat of claim 9, wherein the disc portion of the diaphragm has a flexural bending stiffness of at least 100 pound-inches.

13. The tubular bat of claim 9, wherein the disc portion of the diaphragm has a strength of at least 5,000 pounds per square inch.

14. The tubular bat of claim 9, wherein the diaphragm is a first diaphragm located within the internal cavity and wherein the bat has a second diaphragm located within the internal cavity and spaced apart from the first diaphragm.

15. A tubular bat for striking a ball, the bat comprising:

a handle portion configured to be held by a player;

a tubular barrel portion configured to strike the ball, the tubular barrel portion having a bat wall having an inner surface and an outer surface and defining an internal cavity with an internal diameter;

a tubular taper portion connecting the handle portion and the barrel portion; and a stiffening member located within the internal cavity, the stiffening member having a peripheral edge mounted to the inner surface of the bat wall for dividing the internal cavity into at least two cavities, the stiffening member defining an outer U-shaped ring portion and an inner disc portion, the U-shaped ring portion forming an annular gap located between the inner surface of the barrel and the inner disc portion;

wherein, in use, upon contact with the ball, the stiffening member is configured to deform by a predetermined amount before an outer wall of the U-shaped ring portion contacts the inner disc portion for providing a limited trampoline effect to the bat.

16. The tubular bat of claim 15, wherein a radial compression force required to deform the bat wall near the stiffening member increases by at least 100 lb/in when the outer wall of the U-shaped ring portion of the stiffening member contacts the inner disc portion.

17. The tubular bat of claim 15, wherein the stiffening member has a weight between about 0.18 ounces and about 3 ounces.

18. The tubular bat of claim 17, wherein the stiffening member has a weight between about 0.5 ounces and about 2 ounces.

19. The tubular bat of claim 15, wherein the inner disc portion of the stiffening member has a flexural bending stiffness of at least 100 pound-inches.

20. The tubular bat of claim 15, wherein the inner disc portion of the stiffening member has a strength of at least 5,000 pounds per square inch.

21. The tubular bat of claim 15, wherein the stiffening member is a first stiffening member located within the internal cavity and wherein the bat has a second stiffening member located within the internal cavity and spaced apart from the first stiffening member.

22. The tubular bat of claim 15, wherein the peripheral edge of the stiffening member is fastened to the inner surface of the bat wall.

* * * * *